United States Patent [19]

Estlund et al.

[11] Patent Number: 4,534,556

[45] Date of Patent: Aug. 13, 1985

[54] BREAK-AWAY BASKETBALL GOAL

[76] Inventors: Paul D. Estlund, 4174 S. Kalispell, Aurora, Colo. 80013; Kenneth F. Estlund, 8983 Inspiration Dr., Parker, Colo. 80134

[21] Appl. No.: 763,221

[22] Filed: Jan. 27, 1977

[51] Int. Cl.[3] ..... A63B 63/08

[52] U.S. Cl. ..... 273/1.5 R

[58] Field of Search ..... 273/1.5, 105; 172/261-266, 269; 248/475 A, 475 B

[56] References Cited

U.S. PATENT DOCUMENTS

| | | | |
|---|---|---|---|
| 790,410 | 5/1905 | Warne | 172/265 |
| 1,194,006 | 8/1916 | Fry | 172/265 |
| 2,506,443 | 5/1950 | Court | 172/265 |
| 2,935,144 | 5/1960 | Graham | 172/265 |
| 3,194,555 | 7/1965 | Humphrey | 273/1.5 R |
| 3,402,773 | 9/1968 | Jennings et al. | 172/265 |
| 3,468,382 | 9/1969 | Quanbeck | 172/264 |
| 3,795,396 | 3/1974 | Kropelnitski | 273/1.5 A X |
| 4,111,420 | 9/1978 | Tyner | 273/1.5 R |
| 4,365,802 | 12/1982 | Ehrat | 273/1.5 R |

FOREIGN PATENT DOCUMENTS

| | | | |
|---|---|---|---|
| 604945 | 9/1960 | Canada | 172/264 |
| 1479428 | 3/1967 | France | 248/475 B |
| 613310 | 11/1948 | United Kingdom | 172/269 |

*Primary Examiner*—Paul E. Shapiro

*Attorney, Agent, or Firm*—Francis B. Francois

[57] ABSTRACT

A basketball hoop is provided with supporting arm structure which is pivotally connected to a backboard, so that the hoop is movable downwardly from a normal, horizontal position to a break-away position. A detent mechanism is arranged to releasably secure the hoop in its normal horizontal position, but will disengage when a force of predetermined value is applied to the hoop. The hoop is then free to pivot downwardly into its break-away position. A reset mechanism is provided to return the hoop to its normal, horizontal position upon abatement of the applied force, and the detent mechanism is designed to be automatically re-engaging during such return movement.

5 Claims, 13 Drawing Figures

FIG. 1
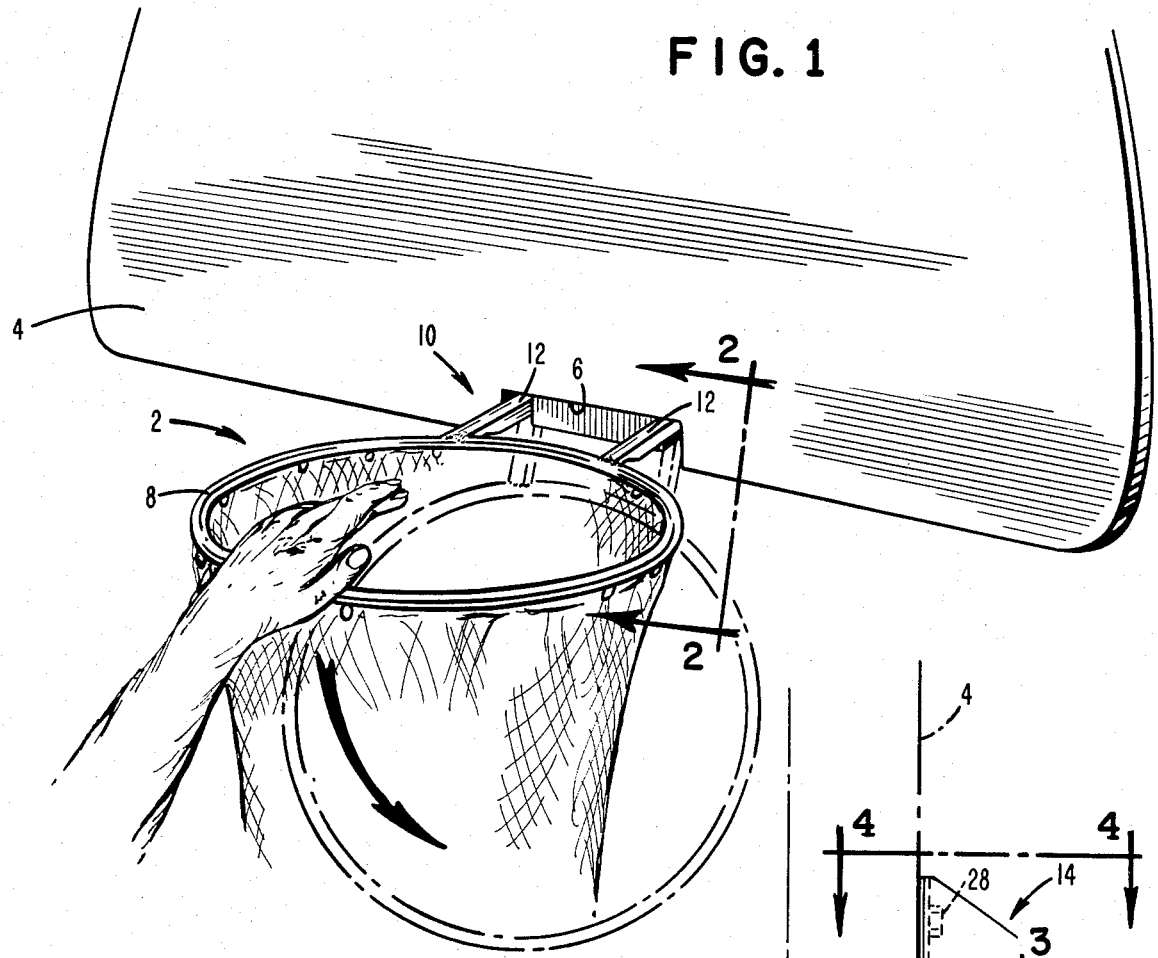
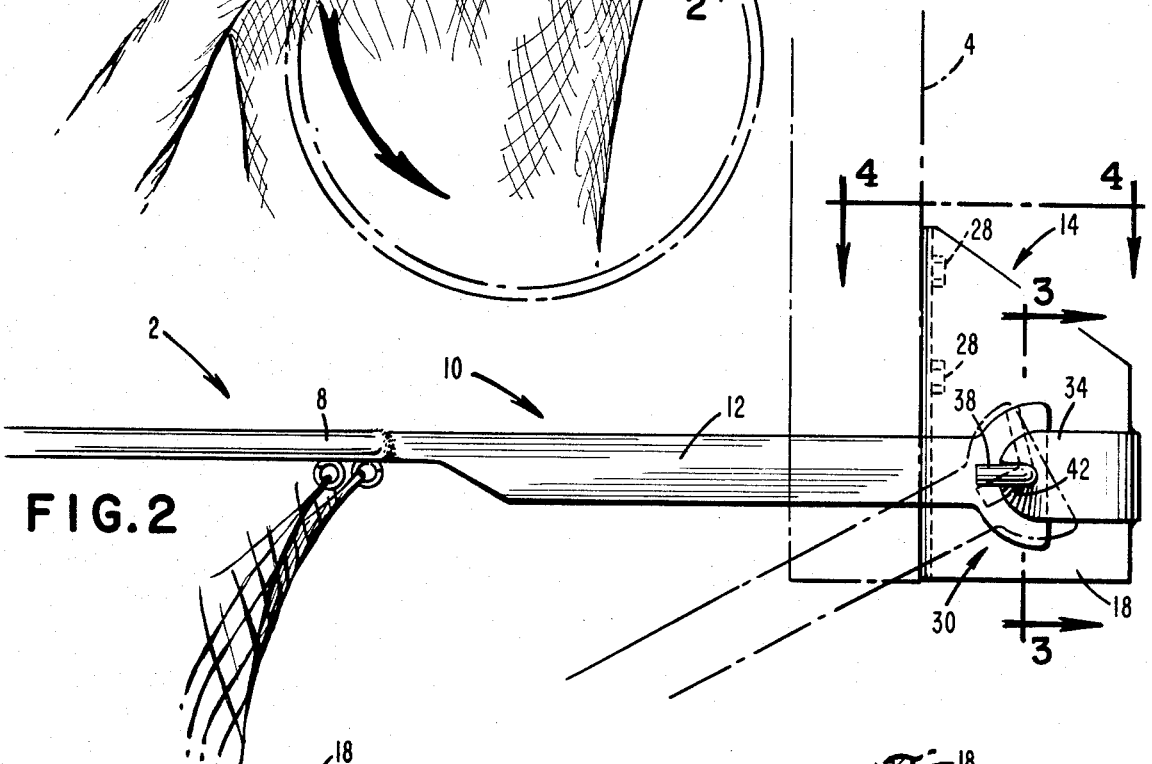
FIG. 2
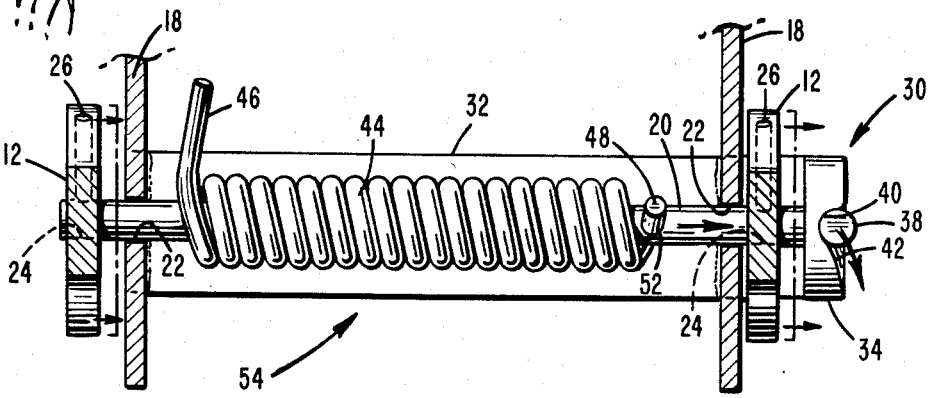
FIG. 3

FIG. 11
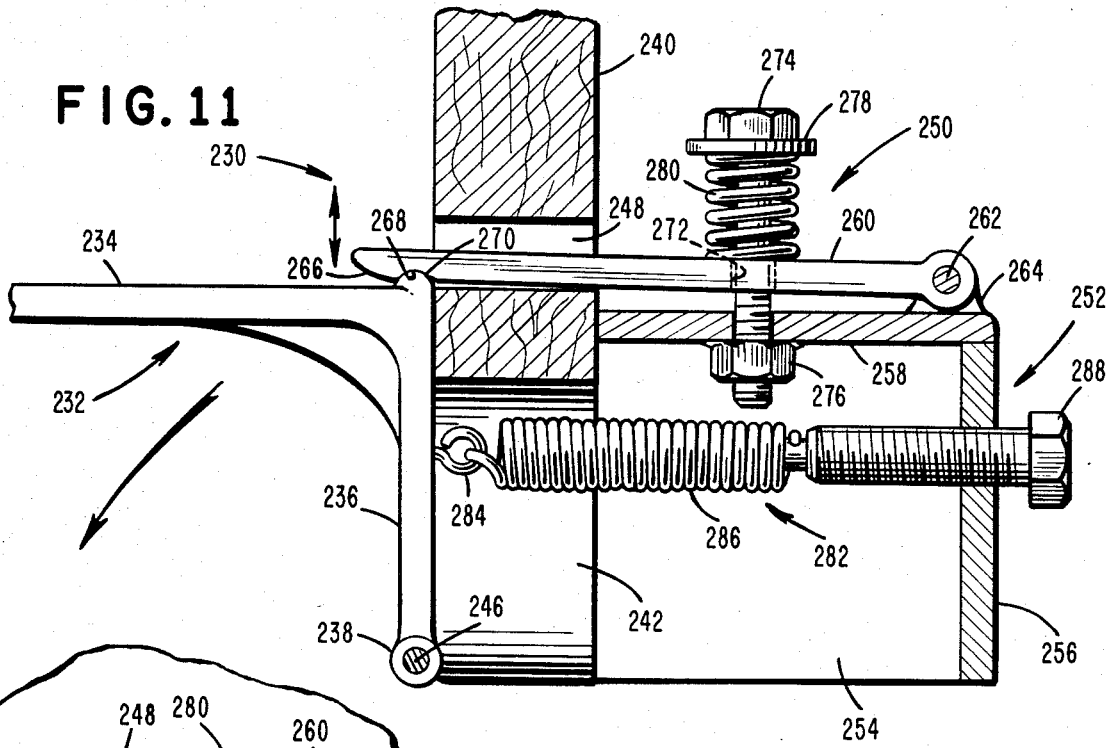
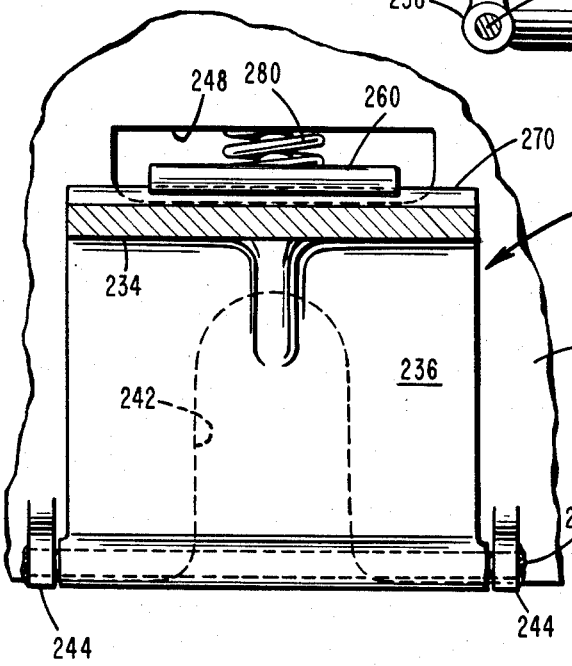
FIG. 12
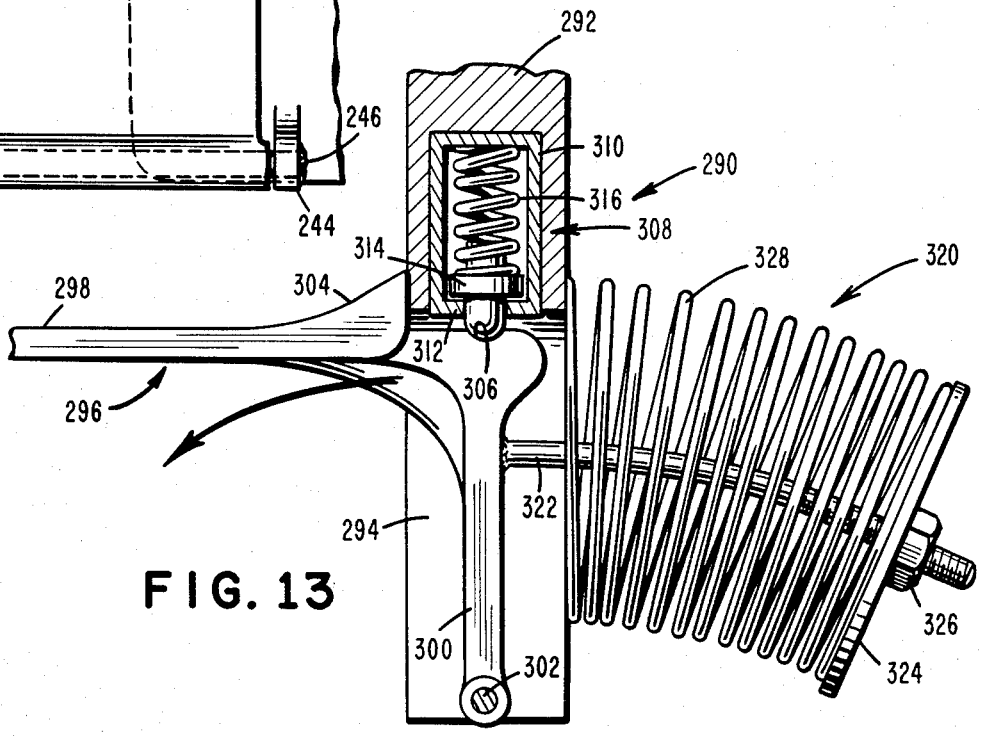
FIG. 13

BREAK-AWAY BASKETBALL GOAL

BACKGROUND OF THE INVENTION

1. Field of the Invention

The present invention relates generally to goals for use in playing the game of basketball, and to means for mounting such goals. More particularly, it relates to a new basketball goal arrangement designed so that the hoop thereof can break-away when a predetermined force is applied thereto, and which will return the hoop to its normal horizontal position when the applied force has abated.

2. Description of the Prior Art

The game of basketball is now played world-wide, both indoors and out, by seasoned professionals, high school and college students, and amateurs alike. The popularity of the game is enhanced by the simplicity of its playing equipment, which includes a suitable playing surface on which a basketball court can be established, two goals, one for each end of the court, and a basketball.

Over the years the goal used in the game has emerged from a simple basket, from which the game drew its name, to a circular metal hoop 18 inches in diameter, and which normally carries a mesh net thereon designed to momentarily check the basketball as it passes downwardly through the hoop. The hoop is mounted on or just beneath a backboard, and the backboard is mounted in an elevated position so that the upper edge of the hoop is 10 feet above the playing surface.

While the circular hoop itself is standardized world-wide, a number of different devices have been proposed for mounting thereof. Usually, the hoop is provided with supporting arms that are secured to a mounting bracket, and the latter will normally be secured directly to the face of the backboard. In other instances, the hoop supporting arm can be secured to structure that is itself separate from the backboard, as is shown in U.S. Pat. No. 3,462,143, for example.

Regardless of the mounting structure for the hoop, it is normal practice to mount it so that it is rigidly secured in a horizontal position. The hoop must be sufficiently rigid so that it can withstand the several forces applied thereto during a game, created by the ball bouncing off the rim, or by players coming in contact therewith, and the like.

The rigid basketball hoop has been in use for decades, and until recently has functioned very well. However, in recent years, as basketball players have become taller, the hoops have been subjected to increasing abuse from contact with the players. In some instances this has resulted in damage to the hoop and or the backboard, and somtimes injury to the players.

A special problem has occurred with the glass backboards now in use in many auditoriums and gymnasiums. The preferable way to mount a basketball hoop is on a bracket that is connected directly to the backboard. When this practice has been followed with glass backboards, it has often occured that the backboard wll be shattered during play when one or more players descend heavily on the rigid hoop. In an effort to solve this problem, the hoop has been mounted separately from the backboard, as in the abovenoted U.S. Pat. No. 3,462,143.

The arrangement of the cited patent does lessen the chance of damage to the backboard, but the new relationship of the hoop to the backboard is considered less than fully desireable by some players. Moreover, the problem of damage to the hoop and injury to a player from the still relatively rigid hoop still exists. In addition, the arrangement of the patent is expensive to construct, and hence is not suitable for widespread application on parkland, school and home playing courts.

All of the present concerns about damage and injuries resulting from basketball play with the conventional rigid hoop have been greatly exacerbated recently by the increasingly physical nature of basketball, and particularly by great reliance on the so-called "dunk shot" as a playing tactic. In the dunk shot, the player jumps upwardly with the ball in his outstretched arms and hands, and then drives it downwardly through the loop. Obviously, the chance of player contact with the hoop during such a dunk shot is quite likely, and indeed such often occurs.

Given today's taller, physically larger, and more aggressive players, and the use of the dunk shot, the hoop of the basketball goal is subject to abuse as never before. It is not unknown for a hoop to be badly bent or simply broken off during play, or for a player to be injured as a result of contact with an unyielding hoop. But thus far, no acceptable replacement has been found for the conventional rigid hoop.

Another problem with the rigid basketball hoop occurs because of today's rising tide of vandalism, particularly in urban areas. Many outdoor basketball courts, in particular, have been rendered unserviceable because individuals have jumped up, grabbed on to the hoop, and bent it downwardly. No economical solution to this problem has yet been found, and thus replacement of the damaged goal is usually the only alternative. With public agencies finding increasing difficulty in meeting their budgets, these replacement costs are becoming an increasing burden.

There is a need for a new kind of basketball goal, one that can accommodate today's playing conditions, and in particular the dunk shot, and which is also relatively vandal proof. The present invention is directed toward such a basketball goal.

SUMMARY OF THE INVENTION

The present invention provides a basketball goal that can be utilized for normal play of the game, and wherein the goal is usually rigid, and responds in the normal manner as a basketball strikes it and bounces off. However, should a force in excess of a predetermined value be applied to the hoop, as can occur if the player hangs on the hop during a dunk shot or a vandal deliberately grabs the hoop and hangs on, the hoop will break-away. After the applied force has abated, the hoop will be returned to its normal, horizontal position.

This new concept in a basketball goal practically eliminates damage to the hoop or the backboard during normal play, and greatly reduces the possibility of a player being injured because of collision with the basket during a dunk shot or the like. Further, the invention is of value in reducing damage from vandalism, and indeed eliminates one of the more common causes of vandalism damage.

In the invention, a regulation hoop is provided with a supporting arm structure, and the latter is pivotally mounted so that the hoop can pivot downwardly from a normal, horizontal position, to a break-away position. A releasable detent mechanism is constructed and arranged to normally secure the hoop in its horizontal position, but will release when force in excess of a given value is applied to the hoop, whereupon the hoop will pivot downwardly.

The detent mechanism can assume several different configurations, and in certain embodiments of the invention can be adjusted to accomodate different values for the applied force that will initiate release. This feature makes it possible to set a selected applied force value for each goal that is identical to a prescribed standard, such as would normally be required for tournament or professional play. In all instances, the detent mechanism is effective to hold the hoop rigid during normal play, so that a basketball impinging thereon will bounce off in the usual manner.

In certain use situations, it would be acceptable to provide for manual return of the hoop from its break-away position, to its normally horizontal position. For example, in an inexpensive basketball goal for home or light outdoor use, this might prove acceptable. Under such an arrangement, once the hoop has moved to its break-away position, the user can simply swing it back up into its normal horizontal position, the detent mechanism of the invention being constructed so that it will re-engage during such movement.

For nearly all installations, however, it would be preferable for the hoop to return automatically from its break-away to its normal position. This will avoid interruptions to the game, which could be disruptive and time consuming. Further, in the case of vandalism activities, it would eliminate the need for an attendant to periodically visit the basketball court. The present invention includes a reset mechanism that will accomplish this automatic returning of the hoop to its normal position.

The reset mechanism can obtain its motivating force from a plurality of sources. For example, a hydraulic motor might be employed, or an electrical actuator of the solenoid or some other type could be used. In the latter case, the same solenoid could even function as the detent mechanism, if desired. However, it has been found that the simplest and most economical arrangement is to use a resilient member as a motivating device, and in particular a metallic spring.

The preferred embodiments of the invention utilize tension, compression or torsion spring members, depending upon the particular embodiment. In each case, the spring member is mounted and arranged so that it is effective to return the hoop from its break-away position, and at the same time cause the detent mechanism to be re-engaged.

It is the principle object of the present invention to provide a basketball goal arrangement including a hoop that is mounted to remain in a horizontal position during normal play, but which can break-away when a force in excess of a preselected value is applied thereto.

A further object is to provide a basketball goal arrangement with a break-away hoop, and which includes means to automatically reset the hoop from its break-away to its normal horizontal position.

Another object is to provide a break-away basketball goal that can be economically constructed, and which is relatively maintenance free.

Yet another object is to provide a break-away basketball goal incuding a detent mechanism for releasably securing the hoop of the goal in its normal position, the detent mechanism being designed to provide for normal play.

Still another object is to provide a detent mechanism for a break-away basketball goal that can be set to accomodate a selected break-away force.

It is also an object of the invention to provide a reset mechanism for a break-away hoop, designed to return the hoop to its normal position, and at the same time to re-engage the detent mechanism securing the hoop.

Other objects and many of the attendant advantages of the invention will become readily apparent from the following Description of the Preferred Embodiments, when taken in conjunction with the accompanying drawings.

BRIEF DESCRIPTION OF THE DRAWINGS

FIG. 1 is a fragmentary, perspective view showing a backboard equipped with a first embodiment of the break-away goal of the invention, the hoop of the goal being shown in its break-away position by phantom lines;

FIG. 2 is an enlarged, fragmentary side elevational view of the goal assembly of FIG. 1, taken generally along the line 2—2 in FIG. 1, and showing the supporting arm structure in both the normal and break-away positions thereof;

FIG. 3 is a sectional view taken generally along the line 3—3 in FIG. 2, and shows the arrangement of the torsion spring and the shaft of this embodiment;

FIG. 11 is a fragmentary, side elevational view, partly in section, of a fourth embodiment of the break-away goal assembly of the invention, showing in particular the adjustable tension spring arrangement for biasing the hinged, L-shaped supporting arm structure toward its normal position, and the adjustable detent mechanism;

FIG. 12 is a fragmentary, front elevational view, partly in section, of the goal assembly of FIG. 11; and FIG. 13 is a view similar to FIG. 11, showing a modification of the fourth embodiment of the invention wherein an L-shaped supporting arm structure is pivoted centrally of a slot opening in a modified backboard, the tension spring reset mechanism of FIG. 11 being replaced by a compression spring mechanism, and the spring-biased detent member being carried by the modified backboard.

DESCRIPTION OF THE PREFERRED EMBODIMENT

Figure 4:
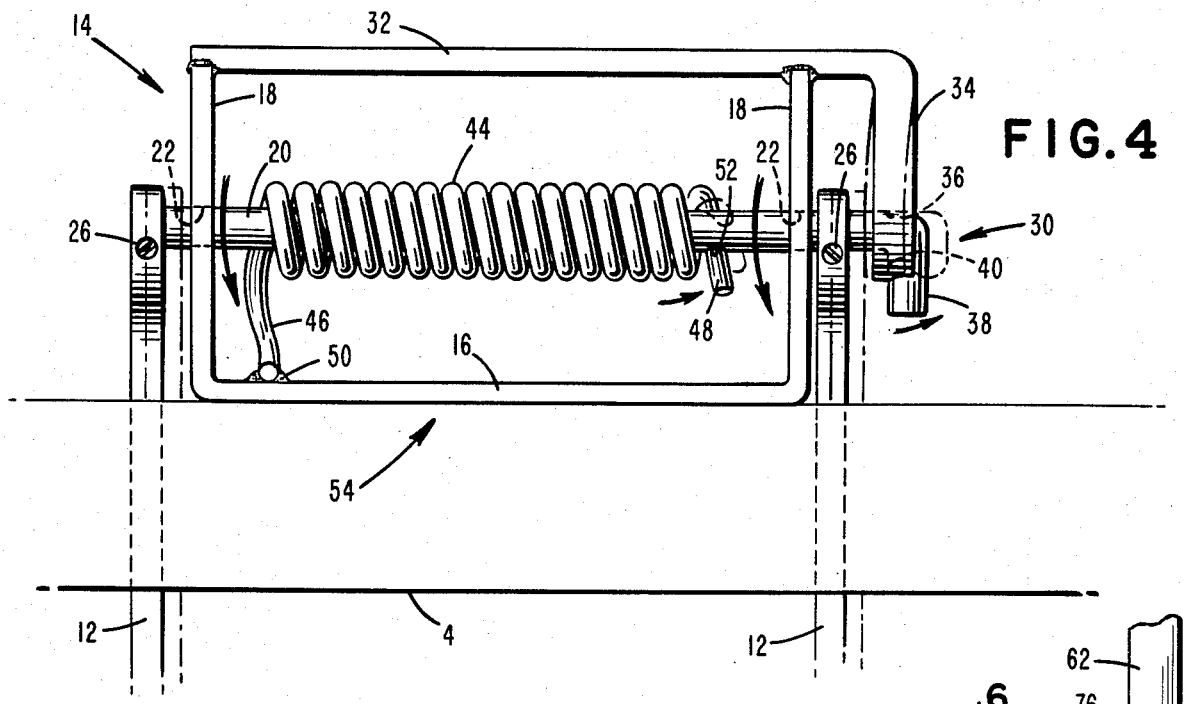
FIG. 4 is a top plan view of the goal assembly of FIG. 1, taken generally along the line 4—4 in FIg. 2, and showing in particular the mounting bracket and the detent mechanism elements carried thereby.

As will be appreciated from a review of the drawings, the present invention can be constructed in many different embodiments. The break-away goal can be carried by a bracket that is mounted on the rear of a backboard, or it can be mounted directly on the face of a conventional backboard. Further, in other embodiments of the invention the break-away goal is pivoted directly to a modified backboard. The particular embodiment chosen for use will depend on many factors, including whether a conventional backboard is to be replaced, the type and quality of basketball play that is expected, and the fiscal limitations placed on the user facility. All embodiments of the invention, however, are based on the same inventive concept.

Referring now to FIGS. 1–4, a first embodiment of the break-away basketball goal of the invention is shown generally at 2, mounted on a backboard 4 having a centrally disposed notch 6 in the lower edge thereof. The goal 2 includes a circular hoop 8 having supporting arm structure 10 connected thereto, which structure includes a pair of spaced, generally parallel suppot arms 12.

The goal 2 is connected to the backboard 4 by a mounting bracket 14, which includes a base plate 16 having a pair of spaced end flanges 18 projecting normally therefrom. A horizontally disposed shaft 20 is rotatably mounted within aligned bores 22 in the end flanges 18, and the opposite ends thereof are received through bores 24 in the outer ends of the support arms 12 and are secured to said arms by set screws 26, or other suitable means. If desired, arms 12 can simply be welded to the shaft 20.

The base plate 16 of the bracket 14 is secured to the rear face of the backboard 4 by bolts 28, whereby the hoop 8 is pivotally mounted for movement between a normally horizontal position, shown by full lines in FIGS. 1 and 2, and a break-away position, shown by phantom lines in said FIGS. The hoop 8 is held in its normal, horizontal position by a detent mechanism, indicated generally at 30.

The detent mechanism 30 includes a bar 32 welded to the end flanges 18, and which extends parallel to the shaft 20. The bar 32 has a resilient arm 34 on one end thereof, which extends parallel to one of the end flanges 18, and which has a bore 36 therein through which one end of the shaft 20 projects, said shaft end having a bent portion 38 thereon that extends normally to the axis of the shaft. The shaft bent portion 38 engages the outer face of the resilient arm 34, and the latter has a groove 40 therein extending radially from the bore 36 and which is shaped to seat the round shaft portion 38.

The groove 40 is so positioned that the shaft bent portion 38 is seated therein when the hoop 8 is in its normal, horizontal position. The downward side of the groove 40 flows into a tapered cam surface 42, on which the bent shaft portion 38 rides when the hoop 8 is moved from its normal, horizontal position toward its break-away position, and return.

A coil spring 44 is wrapped about the shaft 20 between the end flanges 18, and includes first and second end portions 46 and 48. The first end portion 46 engages the base plate 16, and is secured thereto by a weld 50, or other suitable means. The second spring end 48 is passed through a bore 52 provided in the shaft 20. Thus, the coil spring 44 acts like a torsion spring, when the hoop 8 is moved toward its break-away position.

The coil spring 44 is a part of both the detent mechanism 30, and a reset mechanism, indicated generally by the reference number 54. As a part of the detent mechanism 30, it functions to pull the shaft 20 and the supporting arm structure 10 connected thereto in a direction to seat the bent shaft portion 38 in the groove 40, the spring 44 being placed under tension for this purpose. The amount of tension in the spring will directly determine the amount of force that can be applied to the hoop 8, before the detent mechanism 30 releases and the hoop is allowed to move into its break-away position. Thus, by properly choosing the spring 44, the applied break-away force for the goal 2 is determined.

Actually, the resilient arm 34 also plays a roll in the detent mechanism 30, in that it is also deflected during break-away of the hoop 8, as indicated by phantom lines in FIG. 4. This flxing of the arm 34, coupled with axial movement of the shaft 20 against the pull of the spring 44, allows downward pivoting motion of the hoop 8 to occur.

If desired, the device can be constructed so that the resilient arm 34 is the principal resilient force in the detent mechanism 30. To accomplish this, the spacing between the arms 12 is reduced until it is just barely greater than the distance between the outer faces of the end flanges 18. This will eliminate substantially all axial shifting of the shaft 20, and will thereby greatly reduce the roll of the coil spring 44 in the detent mechanism 30. Instead, the resilient arm 34 will then function to retain the hoop 8 in its normal horizontal position, and it will need to be constructed of a spring steel suitable for this function.

A disadvantage of utilizing only the resilient arm 34 to retain the hoop 8 is that precise selection of the applied break-away force required to overcome the detent mechanism is somewhat difficult, being dependent on the material selected for the bar 32 and the precision used in manufacturing the device. However, this arrangement is economical, and rugged in use.

The way in which the detent mechanism functions in FIGS. 1–4 is believed obvious, the mechanism 30 being effective to hold the hoop 8 in its erect position until a sufficient force has been applied to the hoop. Thereupon, the hoop 8 will be swung donwardly, into its break-away position. The reset mechanism 54 is then effective to return the hoop 8 to its original position.

As the shaft 20 rotates during downward movement of the hoop 8, the coil spring 44 is wound in torsion. When the applied deflecting force abates, this torsion spring force is effective to rotate the shaft 20 in the opposite direction, effecting return of the hoop 8. As this return movement accelerates, a substantial force will be generated that will be sufficient to seat the shaft bent position 38 in the groove 40, stopping upward movement of the hoop 8, and fixing the hoop in its normal, horizontal position. It is thus seen that the coil spring 44 functions in tension as a part of the detent mechanism 30, and in torsion as the driving force in the reset mechanism 54.

Figure 5:
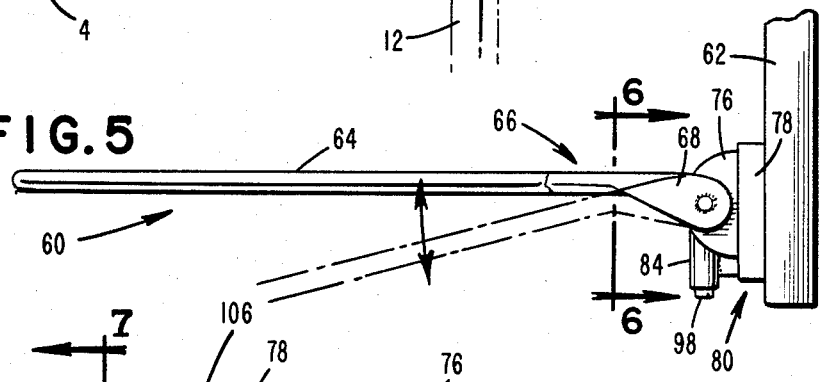
FIG. 5 is a fragmentary, side elevational view showing a second embodiment of the goal assembly of the invention.
Figure 6:
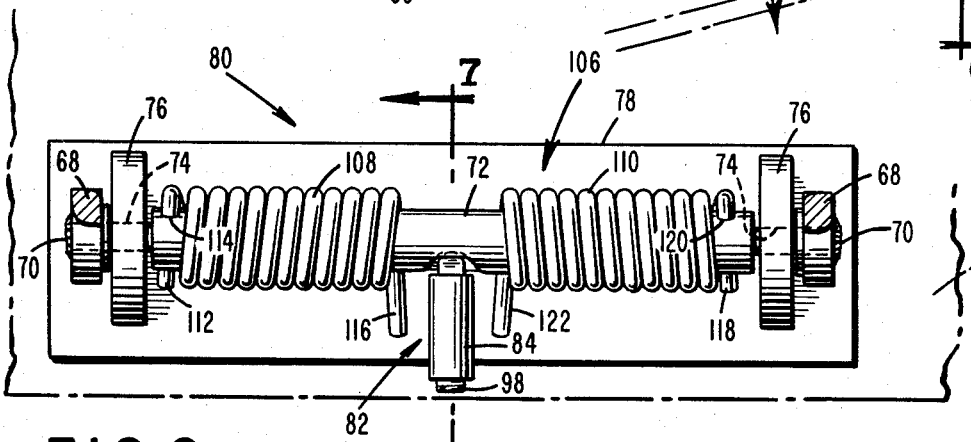
FIG. 6 is an enlarged, fragmentary, front view of the goal assembly of FIG. 5, taken generally along the line 6—6 in FIG. 5, and showing the arrangement of the two torsion springs and the center mounted detent mechanism.
Figure 7:
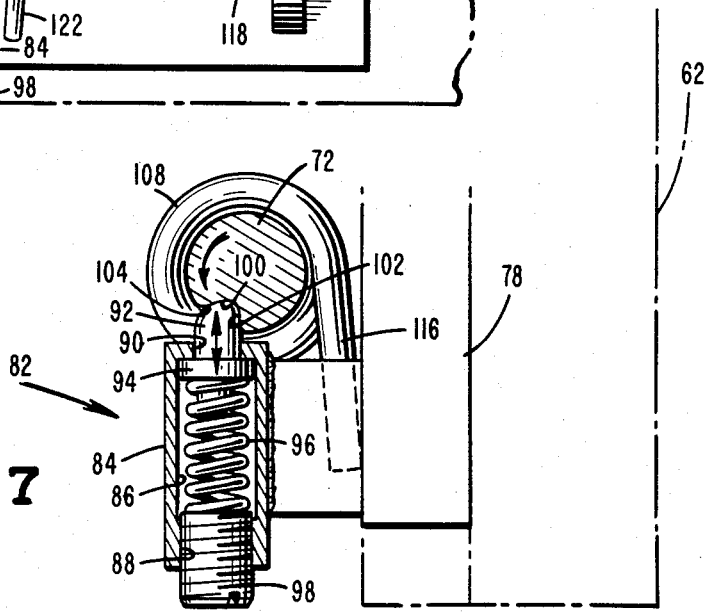
FIG. 7 is an enlarged sectional view taken along the line 7—7 in FIG. 6, and showing the construction of the adjustable detent pin.

Turning now to FIGS. 5–7, a second embodiment of the break-away basketball goal of the invention is shown generally at 60, the goal 60 being mounted directly on the front surface of a backboard 62, and including a circular hoop 64 having supporting arm structure 66 attached thereto. The supporting arm structure 66 includes a pair of spaced support arms 68, which are fixed to the reduced diameter opposite end portions 70 of a shaft 72.

The shaft 72 is received through aligned bores 74 provided in spaced flanges 76 carried by a base plate 78, the flanges 76 and the base plate 78 comprising a mounting bracket assembly 80 that is secured to the backboard 62 by suitable means, say by bolts, or even welding, in the instance of steel backboard. The hoop 64 is thus pivotally mounted on the backboard 62, for movement between its normal, horizontal position and a downward, break-away position, as shown in FIG. 5.

The hoop 64 is held in its normal, horizontal position by a detent mechanism 82, which includes a vertical housing 84 mounted centrally on the base plate 78 beneath the shaft 72. The housing 84 has a bore 86 therein, one end 88 of which is threaded, and the other end of which terminates in a reduced diameter opening 90 through which the cylindrical body 92 of a flanged member 94 projects. A coil spring 96 is received within the bore 86 beneath the flanged detent member 94, and is held in place by a screw 98. By adjusting the position of the screw 98, the pressure exerted on the detent member 94 by the coil spring 96 can be adjusted to any selected value, over the rating of the spring.

The shaft 72 has a groove 100 positioned centrally thereof, which includes a radial wall 102 that functions as a stop, and a curved cam wall 104. The head of the flanged detent member 94 is engageable with the groove 100, to releasably secure the hoop 64 in its normal, horizontal position. The detent mechanism 82 will function to hold the hoop 64 horizontal during normal play. When a sufficient deflecting force is applied to the hoop 64 to overcome the compressed coil spring 96, the curved cam wall 104 will depress the flanged detent member 94, whereupon the hoop will pivot downwardly toward its break-away position. By adjusting the position of the screw 98, the hoop can be adjusted to break-away at a selected applied deflecting pressure.

Once the applied force has abated, the hoop 64 can be returned to its normal, horizontal position. This can be done manually, if desired, simply by swinging the hoop 64 upwardly until the detent member 94 is re-engaged in the groove 100, the radial wall 102 assuring accurate positioning of the hoop. However, FIGS. 5–7 include an automatic reset mechanism for returning the hoop 64, such being indicated generally at 106.

The reset mechanism 106 includes a pair of coil springs 108 and 110, both received on the shaft 72 between the flanges 76 on opposite sides of the detent mechanism 82. The coil spring 108 includes a first end portion 112 that is received through a bore 114 in the shaft 72, and a second end portion 116 that engages the base plate 78. Similarly, the second coil spring 110 includes a first end portion 118 engaged in a bore 120 in the shaft 72, and a second end portion 122. The second end portions 122 and 116 can be secured to the base plate 78, if desired, and the coil springs 108 and 110 are arranged so that both will be wound during downward movement of the hoop 64.

As will be evident, the reset mechanism 106 will function automatically to return the hoop 64 to its normal, horizontal position. In so doing, the momentum built up during upward movement of the hoop 64 will be sufficient at the end of the movement to re-engage the detent mechanism 82, whereupon normal basketball play can resume.

Figure 8:
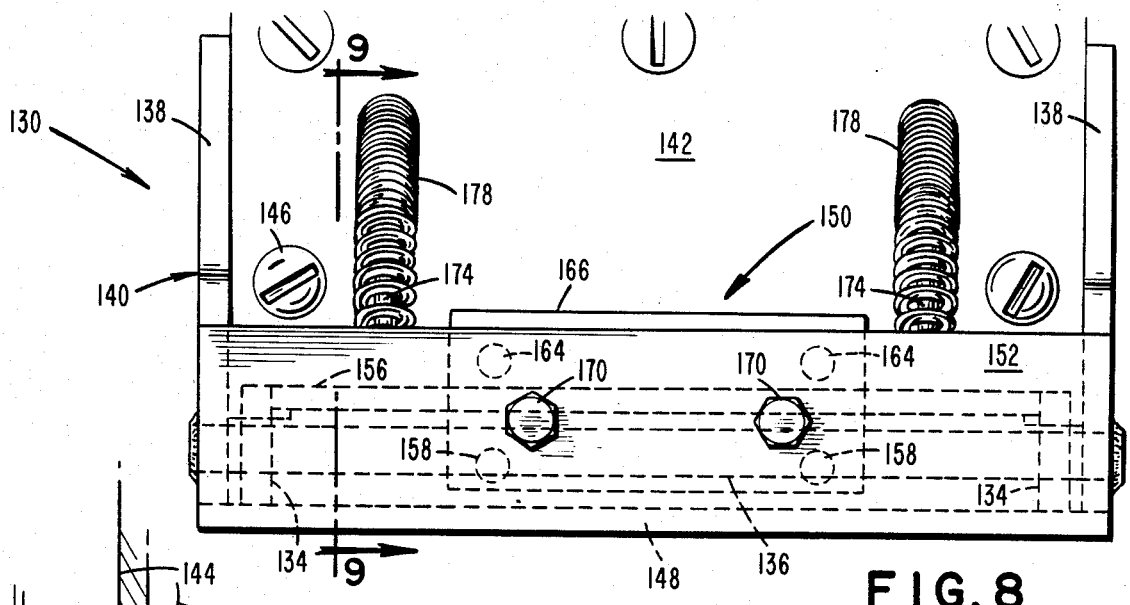
FIG. 8 is a rear elevational view of a third embodiment of the break-away goal assembly of the invention, showing in particular the spaced bow springs and the adjustable detent mechanism.
Figure 9:
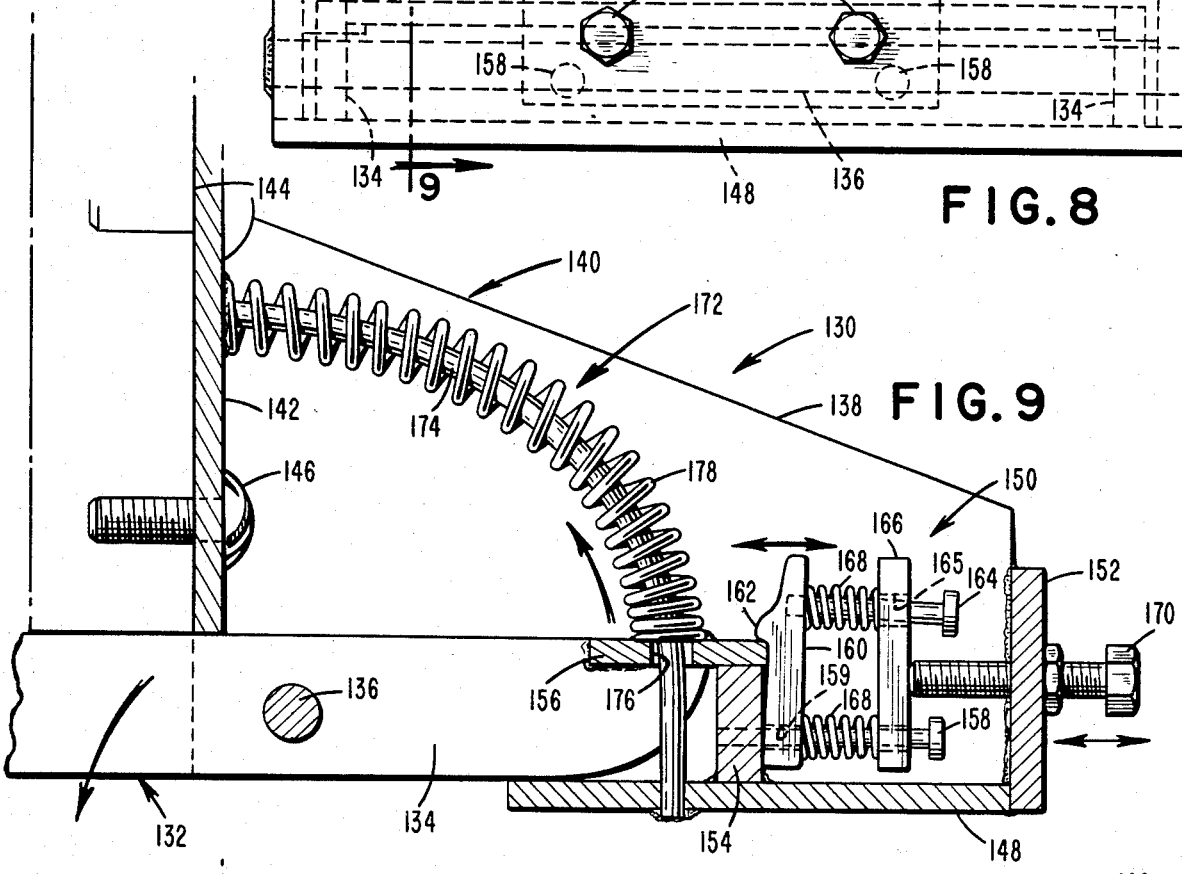
FIG. 9 is a side elvational sectional view of the embodiment of FIG. 8, taken generally along the line 9—9 in FIG. 8, and showing details of the supporting arm structure and how such cooperates with the adjustable detent mechanism.

A third embodiment of the invention, utilizing compressed springs as a motivating force in the reset mechanism instead of torsion springs, is shown in FIGS. 8 and 9. The goal of the third embodiment is indicated generally at 130, and includes a hoop (not shown) having supporting arm structure 132 attached thereto, the supporting arm structure 132 including a pair of spaced support arms 134 pivotally mounted on a shaft 136 carried by the spaced end flanges 138 of a mounting bracket 140. The mounting bracket 140 includes a base plate 142 that is secured to the rear surface of a backboard 144 by bolts 146, or other suitable means, and has a bottom plate 148 that extends between the end flanges 138 and which functions as a stop to engage the ends of the support arms 134 to accurately position the hoop in its horizontal position.

A detent mechanism is indicated generally at 150, and includes a front plate 152 carried by the end flanges 138 of the bracket 140, and a mounting plate 154 that is welded to the upper surface of the bottom plate 148 in front of the outer ends of the support arms 134. The support arms 134 are connected by a bridging member 156, which is adapted to rest on the mounting plate 154 when the hoop is in its normal, horizontal position.

The mounting plate 154 carries a pair of headed members 158, which pass through bores 159 provided in a detent bar 160 to mount the bar for sliding movement toward and away from the mounting plate 154. The detect bar 160 carries a detect 162 on its rear face, which is engageable over the bridging member 156. The detent bar 160 also carries a pair of headed members 164, and the headed members 158 and 164 pass through bores 165 provided in a pressure plate 166, whereby the latter is slidably mounted.

Coil springs 168 are mounted on the headed members 158 and 164 and are compressable between the detent bar 160 and the pressure plate 166. A pair of pressure-applying bolts 170 is carried by the front plate 152, the bolts 170 being engageable with the pressure plate 166 to effect compression of the coil springs 168. As will be appreciated, the applied deflecting force required to effect release of the detent mechanism 150 can be easily set, merely by adjusting the positions of the bolts 170. The detent mechanism 150 is at once rugged in construction, and susceptible to being finely set as to release pressure. Thus, it is suited for use where basketball of a high quality is to be played, and precise release pressures are desired for both basketball goals on the court.

The goal 130 includes a reset mechanism 172, having a pair of arched or bowed guide members 174 that are connected at one end thereof to the base plate 142, and at their other end to the bottom plate 148. The guide members 174 pass through bores 176 provided in the bridging member 156, and are shaped so that upward pivoting movement of the outer ends of the support arms 134 is accomodated. Mounted on each guide member 174 is a compression spring 178, and it is believed obvious how the compression springs function to assure return of the hoop to its horizontal position, and re-engaging of the detent mechanism 150.

Figure 10:
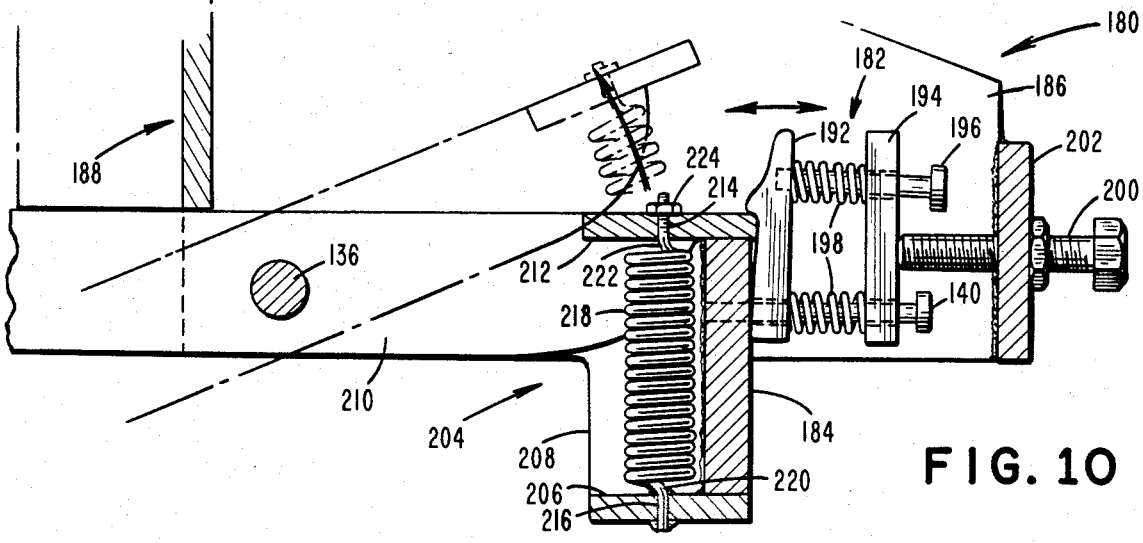
FIG. 10 is a view similar to FIG. 9, but showing a modification of the embodiment of FIGS. 8 and 9 wherein the two bow springs of the reset mechanism are replaced with a tension spring mounted on a bracket extending downwardly from the supporting arm strucure.

Referring now to FIG. 10, a modification of the embodiment of FIGS. 8 and 9 is shown, wherein the reset mechanism is modified to employ a tension spring, rather than the compression bow springs 178.

The break-away basketball goal of FIG. 10 is indicated generally at 180, and includes a detent mechanism 182 constructed on the same principles as the detent mechanism 150, except that the mounting plate 184 has a greater height than the mounting plate 154. The mounting plate 184 is welded between the end flanges 186 of a mounting bracket 188, and carries spaced headed members 190 that mount a detent bar 192 and a pressure bar 194. The detent bar 192 carries headed members 196, and the members 190 and 196 carry compression springs 198. Pressure-applying bolts 200 are carried by the front plate 202 of the bracket 188, and function like the bolts 170 to set the release value for the detent mechanism.

The goal 180 includes a reset mechanism 204 that includes a spring support bar 206, welded to the lower edge of the mounting plate 184, and to extensions 208 of the end flanges 186 of the bracket 188. The ends of the support arms 210 carry a bridging member 212 that is engaged by the detent bar 192, and the bridging member 212 and the support bar 206 have aligned bores 214 and 216, respectively, therein. A coil tension spring 218 is disposed between the bar 192 and the member 212, and includes a lower end portion 220 that is passed through the bore 216, and anchored.

The other end of the spring 218 has a threaded end portion 222 thereon, that is received through the bore 214. A nut 224 is received on the end portion 22, and the force of the tension spring 218 can be adjusted merely by adjusting the position of the nut. The manner in which the reset mechanism 204 functions is believed obvious from the drawings.

Turning now to FIGS. 11 and 12, another embodiment of the break-away basketball goal of the invention is shown generally at 230, and includes a supporting arm structure 232 that supports a hoop (not shown), and which is in the form of an L-shaped member having a normally horizontal portion 234 to which the hoop is attached, and a generally vertical base portion 236 that terminates at its lower end in one-half of a hinge 238. A backboard 240 is provided having a vertical notch 242 in the lower edge thereof, and ears 244 are provided on the front face thereof on both sides of the notch. The arm member 232 is pivotally connected to the backboard 240 by a shaft 246 passing through the ears 244 and the hinge half 238.

As shown in the drawing, the backboard 240 has a slot 248 therein, disposed over the notch 242. The goal includes a detent mechanism indicated generally at 250, which mechanism includes a bracket 252 attached to the rear side of the backboard 240 and having end flanges 254, a front plate 256, and a top plate 258. A detent bar 260 extends through the slot 248, and is pivotally connected by a shaft 262 and ears 264 to the top plate 258. The forward end of the detent bar 260 has a rounded underlip 266, leading to a groove 268. The rear end of the horizontal portion 234 of the supporting arm structure 232 carries a detent 270 thereon, which is seatable in the groove 268.

In order to hold the detent 270 seated in the groove 268, the detent bar 260 has a bore 272 therein, through which a bolt 274 passes. The bolt 274 threads into a nut 276 welded to the undersurface of the top plate 258, and carries a washer 278. A coil spring 280 is compressed between the washer 278 and the top surface of the detent bar 260, and provides the resilient force for seating the detent 270.

The manner in which the detent mechanism 250 operates is believed obvious. The bolt 274 makes it possible to adjust the pressure with which the detent bar 260 is urged toward the detent 270, so that the applied deflecting pressure at which break-away will occur can be set to a desired value.

The goal 230 includes a reset mechanism, indicated generally at 282. The rear face of the vertical base portion 236 of the arm structure 232 has an anchor 284 thereon positioned centrally of the notch 242, and to which one end of a coil spring 286 is secured. The other end of the coil spring 286 is connected to an adjusting bolt 288, carried by the front plate 256. The bolt 288 makes it possible to adjust the value of the reset force, and the notch 242 provides for movement of the coil spring 286 during pivotal movements of the supporting arm structure 232.

A variation on the arrangement of FIGS. 11 and 12 is shown in FIG. 13, wherein the modified basketball goal is indicated generally at 290, and includes a backboard 292 having a centrally disposed notch 294 in its lower edge, corresponding to the notch 242. In the goal 290 the supporting arm structure 296 is also L-shaped, and includes a generally horizontal portion 298 that supports the hoop (not shown), and a generally vertical portion 300 that is receivable in the notch 294 and pivoted to the backboard 292 by a shaft 302. The horizontal arm portion 298 has a stop 304 thereon which positively seats the hoop in its horizontal position, and carries a groove 306 arranged to cooperate with a detent mechanism 308 carried in the backboard 292 at the top of the notch 294.

The detect mechanism 308 includes a housing 310 having an inturned retaining lip 312 therein, which is effective to retain a flanged detent member 314 within the housing. A coil spring 316 is disposed within the housing 310 behind the detent member 314, and functions to retain the detent member 314 in engagement with the groove 306 under normal playing conditions. When a deflecting force of sufficient magnitude is applied to the hoop of the goal 290, the detent mechanism 308 will release.

The goal 290 also includes a reset mechanism, indicated generally at 320, and including a guide bar 322 carried by the rear face of the vertical base portion 300 of the arm structure 296, the outer end of the guide bar 322 being threaded and receiving a washer 324 and a nut 326. A compression spring 328 of large diameter is seated between the washer 324 and the edges of the backboard 292 on opposite sides of the notch 242. It is believed that the manner in which the reset mechanism 320 functions is readily apparent.

While a number of different embodiments of the invention have been shown, it is apparent that others can also be devised, according to the concept of the invention. Thus, it is to be understood that further modifications and variations of the invention are possible, within the teachings provided herein and the attached claims.

We claim:

1. A backboard and break-away basketball goal assembly, including:

a backboard;

a hoop having supporting arm structure thereon, said supporting arm structure including a normally vertically disposed mounting plate having upper and lower ends;

means for pivotally connecting said normally vertically disposed mounting plate of said supporting arm structure to said backboard, including a generally horizontally disposed pivot pin positioned generally at said lower end of said mounting plate, whereby said hoop can be pivoted downwardly about said pivot pin from a normal, horizontal position, to a break-away position;

detent mechanism means carried by said backboard and said mounting plate for releasably securing said hoop in said normal, horizontal position, said detent mechanism means being constructed to disengage when a deflecting force exceeding a predetermined value is applied to said hoop, whereby said applied deflecting force can then pivot said hoop toward said break-away position, and to then reengage during return of said hoop from said break-away position to said normal, horizontal position, said detent mechanism means including:

a detent projection mounted on the upper end of said mounting plate;

bracket means mounted on said backboard;

a generally horizontally disposed detent arm, the rear portion of said arm being secured to said bracket means, and said arm extending toward said hoop and including a nose portion which is mechanically engageable with said detent projection to releasably secure said hoop in said normal, horizontal position;

at least one of said detent projection and said nose portion of said detent arm having a tapered surface thereon to facilitate reengagement of said detent mechanism means; and resilient means acting on said nose portion of said detent arm, urging it toward said pivot pin and into engagement with said detent projection, said resilient means being adjustable, whereby it can be set to disengage in response to the application of a selected deflecting force; and reset mechanism means carried by said backboard and operably connected with said supporting arm structure, said reset mechanism means being effective to automatically return said hoop from said break-away position to said normal, horizontal position thereof.

2. An assembly as recited in claim 1, wherein said reset mechanism means includes:

a tension spring means, one end of said spring means being connected with said bracket means, and the other end thereof being connected with said mounting plate, said backboard being provided with opening means through which said tension spring means extends; and means between said bracket means and said one, connected end of said spring means for adjusting the tension of said tension spring means, said tension spring means providing the force necessary to return said hoop to its normal, horizontal position, and to re-engage said detent mechanism means.

3. A backboard and break-away basketball goal assembly, including:

a backboard;

a hoop having supporting arm structure thereon, said supporting arm structure including a normally vertically disposed mounting plate having upper and lower ends;

means for pivotally connecting said normally vertically disposed mounting plate of said supporting arm structure to said backboard, including pivot pin means positioned generally at said lower end of said mounting plate, whereby said hoop can be pivoted downwardly about said pivot pin means from a normal, horizontal position, to a break-away position;

detent mechanism means carried by said backboard and said mounting plate for releasably securing said hoop in said normal, horizontal position, said detent mechanism means being constructed to disengage when a deflecting force exceeding a predetermined value is applied to said hoop, whereby said applied deflecting force can then pivot said hoop toward said break-away position, and to then reengage during return of said hoop from said break-away position to said normal, horizontal position, said detent mechanism means including:

detent projection means mounted on one of said upper end of said mounting plate and said backboard; and engaging means mounted on the other one of said upper end of said mounting plate and said backboard, said engaging means being positioned and arranged to engage said detent projection means when said hoop is in its normal, horizontal position and said mounting plate is in its generally vertical position;

said engaging means being constructed to include at least one resiliently yieldable portion arranged to mechanically engage with and hold said detent projection means, whereby to enable disengagement of said engaging means from said detent projection means when a deflecting force exceeding a predetermined value is applied to said hoop, and reengagement thereof with said detent projection means when said hoop is returned to its normal, horizontal position, the resilient force exerted by said at least one resiliently yieldable portion being settable mechanically, whereby to adjust said assembly to respond to different applied deflecting forces; and means carried by said backboard and connected with said mounting plate, constructed and arranged to exert a force urging said mounting plate to pivot toward said backboard, whereby to effect automatic re-engagement of said engaging means with said detent projection means after said deflecting force moves said hoop to its break-away position, and application of said deflecting force to said hoop ceases.

4. A backboard and break-away basketball goal assembly, including:

a backboard;

a hoop having supporting arm structure thereon;

means for pivotally connecting said hoop with said backboard, for pivoting movement about a horizontal axis from a normal, horizontal position, to a break-away position;

detent mechanism means carried by said backboard and said hoop and its supporting arm structure for mechanically releasably securing said hoop in said normal, horizontal position, said detent mechanism means being constructed to mechanically disengage when a deflecting force exceeding a predetermined value is applied to said hoop, and to then mechanically re-engage during return of said hoop from said break-away position, said detent mechanism means including at least one resiliently yieldable portion on one of said backboard and said hoop and its supporting arm structure, arranged to mechanically engage with and hold detent projection means provided on the other of said backboard and said hoop and supporting arm structure, said resiliently yieldable portion being mechanically settable whereby to adjust said assembly to respond to different applied deflecting forces; and means connected with said backboard and with said hoop and supporting arm structure, effective for returning said hoop to its normal, horizontal position.

5. A backboard and break-away basketball goal assembly as recited in claim 4, wherein said means effective for returning said hoop to its horizontal position is a spring.

* * * * *